US005142831A

United States Patent [19]

Nelson

[11] Patent Number: 5,142,831

[45] Date of Patent: Sep. 1, 1992

[54] APPARATUS FOR TREATING CORNERED SURFACES

[76] Inventor: Robert T. Nelson, 12601 Arrowhead Terr., Oklahoma City, Okla. 73120

[21] Appl. No.: 646,299

[22] Filed: Jan. 28, 1991

[51] Int. Cl.[5] ..... B24C 9/00

[52] U.S. Cl. ..... 51/424; 51/429; 51/180

[58] Field of Search ..... 51/410, 424, 425, 428, 51/429, 431, 432, 434, 436, 174, 180, 177, 317, 319

[56] References Cited

U.S. PATENT DOCUMENTS

| | | | |
|---|---|---|---|
| 209,173 | 10/1978 | Kidwell . | |
| 923,100 | 5/1909 | Young . | |
| 2,159,051 | 5/1939 | Quinn | 51/9 |
| 2,204,610 | 6/1940 | Minich et al. | 51/9 |
| 2,254,234 | 9/1941 | Minich | 51/9 |
| 2,628,456 | 2/1953 | Berg | 51/8 |
| 2,635,284 | 4/1953 | Hunt | 17/11.1 |
| 2,635,745 | 4/1953 | Mead et al. | 209/35 |
| 2,684,558 | 7/1954 | Harris et al. | 51/2 |
| 2,766,557 | 10/1956 | Pollard | 51/8 |
| 2,850,162 | 9/1958 | Widmer | 209/134 |
| 3,034,262 | 5/1962 | Pawlson | 51/9 |
| 3,262,228 | 7/1966 | Schenck | 51/9 |
| 3,380,196 | 4/1968 | Mabille | 51/9 |
| 3,385,006 | 5/1968 | Miller et al. | 51/8 |
| 3,566,543 | 3/1971 | Fogle | 51/9 |
| 3,608,968 | 9/1971 | Burnett | 299/39 |
| 3,704,552 | 12/1972 | Beaver et al. | 51/9 |
| 3,756,377 | 9/1973 | Goff | 198/140 |
| 3,788,010 | 1/1974 | Goff | 51/9 |
| 3,877,175 | 4/1975 | Snyder | 51/9 |
| 3,900,969 | 8/1975 | Diehn | 51/9 |
| 3,906,673 | 9/1975 | Goto et al. | 51/9 |
| 3,934,372 | 1/1976 | Diehn et al. | 51/8 |
| 3,934,373 | 1/1976 | Leliart et al. | 51/9 |
| 3,977,128 | 8/1976 | Goff | 51/9 |
| 3,981,104 | 9/1976 | Dreher | 51/9 |
| 4,020,596 | 5/1977 | Bergh | 51/9 |
| 4,035,958 | 7/1977 | Nishio | 51/425 |
| 4,052,820 | 10/1977 | Bergh | 51/423 |
| 4,202,141 | 5/1980 | Fricke | 51/412 |
| 4,222,205 | 9/1980 | Lake et al. | 51/420 |
| 4,254,593 | 3/1981 | Paulfenerborn | 51/425 |
| 4,336,671 | 6/1982 | Nelson | 51/424 |
| 4,364,823 | 12/1982 | Goff | 209/135 |
| 4,376,358 | 3/1983 | Shelton | 51/429 |
| 4,377,922 | 3/1983 | Bergh | 51/424 |
| 4,377,923 | 3/1983 | Bergh | 51/424 |
| 4,377,924 | 3/1983 | Bergh | 51/429 |
| 4,382,352 | 5/1983 | Nelson | 51/424 |
| 4,416,092 | 11/1983 | Nelson | 51/425 |
| 4,829,719 | 5/1989 | Braselton | 51/180 |
| 4,941,296 | 7/1990 | Carpenter | 51/433 |

FOREIGN PATENT DOCUMENTS

| | | |
|---|---|---|
| 0032161 | 4/1979 | European Pat. Off. . |
| 0487532 | 6/1938 | United Kingdom . |
| 0002900 | 11/1970 | United Kingdom . |
| 2203368 | 3/1988 | United Kingdom . |

*Primary Examiner*—Bruce M. Kisliuk
*Assistant Examiner*—Eileen Morgan
*Attorney, Agent, or Firm*—Dunlap, Codding & Lee

[57] ABSTRACT

A surface treating device for treating a surface having a corner formed by obstacles such as walls or curbs. The apparatus comprises a housing supported on a movable frame. An opening in the housing defines a blast zone on the surface to be treated. A hopper collects abrasive material and directs it to a propeller. The propeller propels the abrasive material from the hopper toward the blast zone with sufficient kinetic energy that the material rebounds from the surface into a rebound corridor. The rebound corridor has a first linear portion which forms the forward most aspect of the apparatus, and the first linear portion is substantially perpendicular to the surface being treated. From the rebound corridor, the recovered abrasive is returned to the hopper. The apparatus has a rotatable, adjustable handle to facilitate movement alongside and under obstacles. A push plate is provided on the rear of the frame under the handle, thereby making it easier to move the apparatus.

13 Claims, 2 Drawing Sheets

APPARATUS FOR TREATING CORNERED SURFACES

FIELD OF THE INVENTION

The present invention relates generally to devices for treating surfaces and more particularly to devices for treating cornered surfaces.

SUMMARY OF THE INVENTION

The present invention comprises an apparatus for treating a first surface intersected by a second surface, which second surface defines a plane at an angle to the plane of the first surface. The apparatus comprises a housing supported on a movable frame. The housing has an opening at the bottom thereof that defines a blast zone on the first surface. Above the blast zone, the housing defines a blast corridor and a rebound corridor which are continuous with the blast zone. The rebound corridor has a first linear portion which is substantially perpendicular to the plane of the first surface, and the first linear portion of the rebound corridor and blast corridor forma an acute angle.

A propeller is supported in the housing adjacent the blast corridor for propelling abrasive material through the blast corridor towards the first surface. The propeller is capable of imparting sufficient kinetic energy to the abrasive material to treat the first surface and to cause a substantial portion of the abrasive material striking the first surface to rebound a distance therefrom into the first linear portion of the rebound corridor.

A hopper is provided for collecting a supply of abrasive material and feeding the abrasive material to the propeller. The rebound corridor has a second portion which directs the rebounding abrasive material form the first linear portion in to the hopper. That portion of the housing which defines the first linear portion of the rebound corridor forms the forwardmost aspect of the apparatus so that the blast zone can be positioned adjacent the line of intersection between the first surface and the second surface.

The present invention further comprises a surface treating apparatus having a movable frame with a front and a rear. A housing is supported on the frame, and the housing has an opening at the bottom thereof defining a blast zone on the surface to be treated. The housing above the blast zone defines a blast corridor and a rebound corridor. The rebound corridor has a first portion continuous with the blast zone, and the rebound corridor and the blast corridor form an acute angle.

A propeller is supported in the housing adjacent the blast corridor for propelling abrasive material through the blast corridor towards the first surface. The propeller is capable of imparting sufficient kinetic energy to the abrasive material to treat the first surface and to cause the abrasive material striking the first surface to rebound a distance therefrom into the first linear portion of the rebound corridor. A hopper is provided for collecting a supply of abrasive material and feeding the abrasive material to the propeller. The rebound corridor has a second portion which directs the rebounding abrasive material from the first portion into the hopper.

The apparatus further comprises a handle. The handle is movably attached to the rear of the frame. In this way, the distance of the handle from the surface to be treated can be adjusted. Alternately, the handle is movably attached to the frame for rotation relative to the housing. Of course, these features may be combined.

DETAILED DESCRIPTION OF THE PREFERRED EMBODIMENTS

In the use of portable surface blasting machines, a problem often is encountered in treating surfaces which are partially enclosed, that is, bounded on at least one side by a vertical surface formed by a curb or a wall, for example. Machines are now available which can effectively treat the edges of surfaces bounded by a vertical surface on one side, sometimes referred to as edgers. However, difficulties have continued to exist in accessing cornered surfaces, such as floors or other horizontal surfaces bounded by two intersecting vertical surfaces. In these situations, the treatment of the corner area has required manual treatment by small hand tools to complete the preparation of the entire surface.

The present invention eliminates this problem by providing a machine having a housing with a flat front which defines the front edge of the rebound corridor. In this way, both the side and the forwardmost edge of the blast zone are substantially adjacent the two intersecting vertical edges of the corner.

Figure 1:
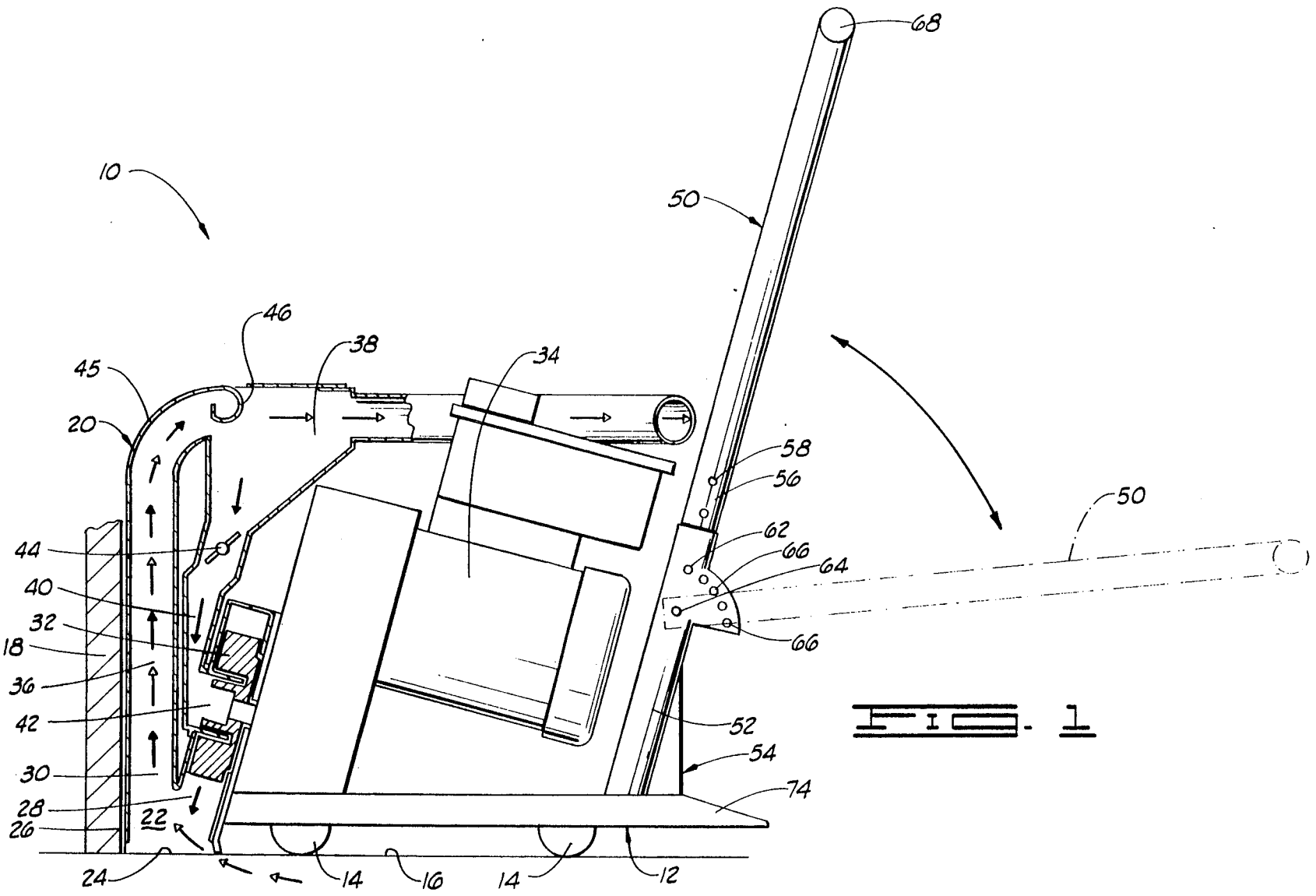
FIG. 1 is a semi-schematic, partially sectional side view of the apparatus for treating cornered surfaces.

With reference now to the drawings in general and to FIG. 1 in particular, there is shown therein an apparatus for treating cornered surfaces constructed in accordance with present invention. The apparatus is designated generally by the reference numeral 10.

The apparatus 10 comprises a frame 12 with castors 14 for movement across a first surface 16, which is the surface to be treated. The first surface 16 is intersected by a second surface 18 which defines a plane at an angle to the first surface. This vertical surface is shown as a vertical wall. However, it will be appreciated that the second surface may be curb or other structure and may not be perfectly vertical.

A housing 20 is supported on the frame 12. The housing 20 has an opening 22 at the bottom thereof. The opening 22 defines the area on the first surface 16 be treated, referred to herein as a blast zone 24. Preferably, the blast zone 24 is surrounded by a skirt 26 which depends from the housing 20 around the opening 22. The skirt 26 should contact or very nearly touch the surface 16. In this way, the skirt 26 will prevent the escape of debris and abrasive material into the surrounding work area.

The housing 20 above the blast zone 24 defines a blast corridor 28 and a rebound corridor 30 continuous with the opening 22. The blast corridor 28 and the rebound corridor 30 form an acute angle for a purpose yet to be described.

A propeller 32 is supported in the housing 20 adjacent and immediately above the blast corridor 28. As used herein, the term "propeller" defines a device capable of projecting or propelling abrasive material, preferably steel shot, through the blast corridor 28 at angle towards the blast zone 24 on the surface 16. The propeller 32 should be capable of imparting sufficient kinetic energy to the abrasive material to treat the surface 16 and also to cause a substantial portion of the abrasive material to rebound a distance from the surface 16. In this way, the rebounding abrasive material will be directed up into the rebound corridor 30 for recycling in the apparatus 10 in a manner yet to be described. The path of abrasive material is indicated in FIG. 1 by solid arrows.

The preferred propeller for practicing the present invention is a center-fed, centrifugal blast wheel. Such wheels are common in the art and therefore need not be described herein.

The propeller usually will be driven by a motor such as the electric motor 34. While an electric motor 34 is shown, the apparatus 10 may utilize a gas, propane or other type of motor. However, the motor should be sized so that no portion of it extends beyond the side of the apparatus 10, as this would prevent the apparatus from treating the surface 16 adjacent a side wall or curb. (See FIGS. 2 and 3.)

As indicated, abrasive material which is propelled by the propeller 32 rebounds up into the housing 20 through the rebound corridor 30. The rebound corridor 30 has a first linear portion 36 which forms the forwardmost aspect of the apparatus 10. The first linear portion 36 is substantially perpendicular to the plane of the first surface 16. This permits the front of the housing to abut the second surface 18 placing the forwardmost portion of the blast zone 24 adjacent the second surface 18.

A hopper 38 is included in the apparatus 10 to collect a supply of abrasive material and to feed the abrasive material to the propeller 32. Preferably the hopper 38 is defined by the housing 20 and is positioned above the propeller 32. The hopper 38 has a neck 40 to direct the abrasive material to the cage 42 in the in the propeller 32. A valve 44, such as a butterfly valve or a pivot vane, preferably is included for regulating the flow of abrasive material through the neck 40.

The rebound corridor 30 has a second portion 44 which directs the rebounding abrasive material from the first linear portion 36 to the hopper 38. A deflector pipe 46 is secured adjacent the discharge end of the second portion 44 of the rebound corridor 30 to dissipate the kinetic energy remaining in the abrasive material. The deflector pipe 46 has openings in it (not shown) which allow abrasive material impacting the pipe 46 to fall into the hopper 38.

In the preferred practice of the invention, dust and debris are removed from recovered abrasive material by air flow. One possible path of air flow is shown in FIG. 1 by the hollow arrows. The debris removal is possible because the debris is substantially lighter than the abrasive material. Accordingly, the apparatus 10 preferably is adapted to operate with a blower or exhaust fan (not shown), both of which are commonly used for this purpose.

To facilitate the manipulation of the apparatus 10 a handle 50 is provided. A support member 52 is rigidly secured to the rear 54 of the frame 12. The upper end of the support 52 is hollow for telescopically receiving the lower end 56 of the handle 50. The lower end of the handle 50 is provided with several throughbores 58 positioned for alignment with throughbores 60 in the upper end of the support 52. Pins 62 and 64 removably attach the handle 50 to the support 52. Now it will be understood that the length of the handle may be adjusted easily and quickly by removing pins 62 and 64, sliding the handle 50 to the desired position, and then replacing the pins.

The upper end of the support member 52 is provided with several secondary throughbores 66. In this way, with the pin 62 removed, the lower end of the handle 50 can be pivoted on the pin 64 to a lower position, that is, a position wherein the handle 50 is closer to the surface 16. In FIG. 1, the handle 50, shown in solid lines, is in its highest position. The handle 50 is shown in broken lines in an intermediate position. Now it will understood that positioning the handle 50 to the lower positions will permit the apparatus 10 to be pushed under a shelf or other structure. This provides access to surfaces which otherwise would be inaccessible.

Figure 2:
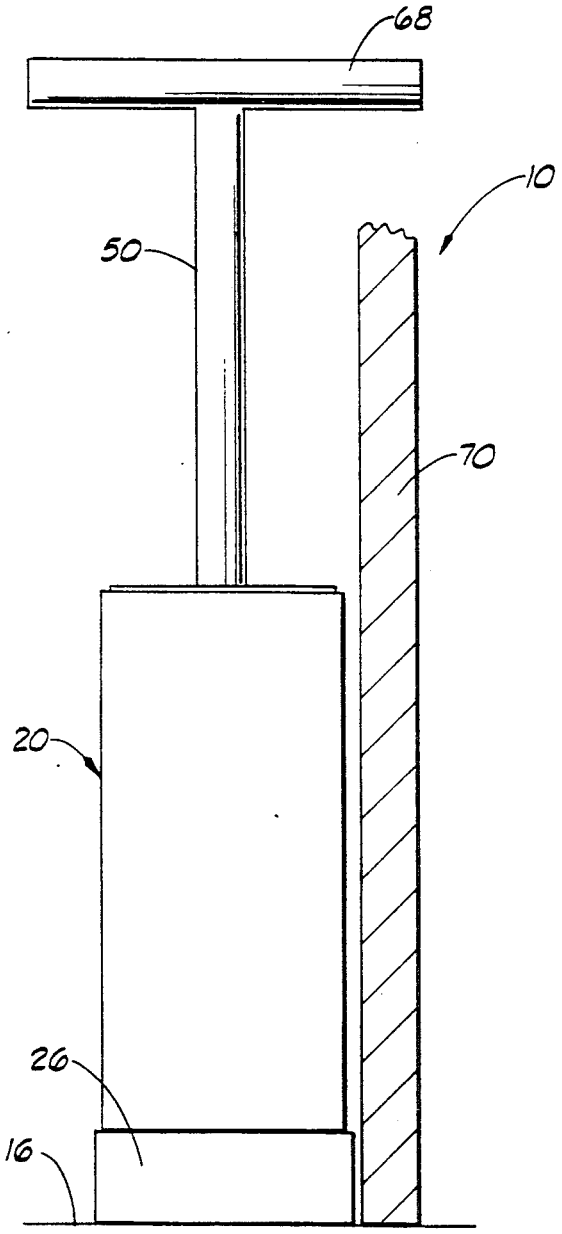
FIG. 2 is a front view of the apparatus of FIG. 1.
Figure 3:
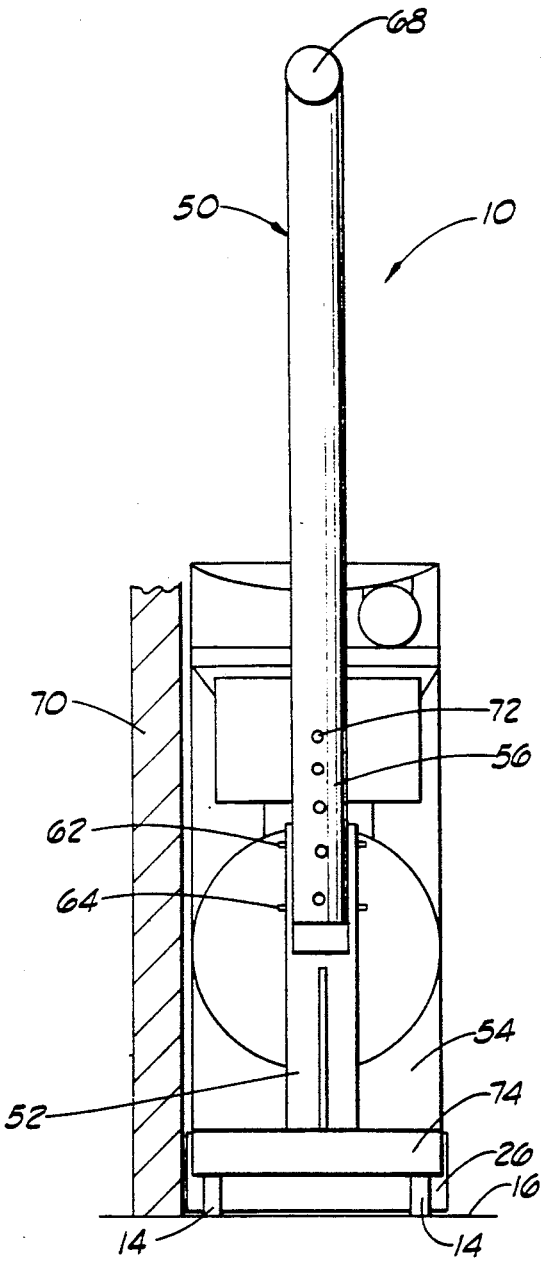
FIG. 3 is a rear view of the apparatus of FIG. 1 with the handle rotated 90°.

Turning now to FIGS. 2 and 3, yet another advantageous feature of the handle is depicted. As depicted in FIG. 2, the cross bar 68 of the handle 50 will usually be wider than the housing 20. This is because a wider handle provides safer and more accurate operation of the apparatus 10. However, when the apparatus 10 is needed to clean a surface along a side wall or structure 70, the width of the cross bar 68 of the handle 50 would obstruct the proper positioning of the apparatus 10.

To remedy this problem, the lower end 56 of the handle 50 preferable is square in cross-section and is provided with a second set of throughbores 72 which intersect the throughbores 58. When the pins 62 and 64 are removed, the handle 50 can be pulled out of the support 52, rotated 90 degrees and replaced. When the pins 62 and 64 are replaced, the handle 50 is securely attached with the cross bar 68 vertically aligned. This prevents the cross bar 68 from interfering with the operation of the apparatus 10 along an adjacent wall 70.

The apparatus 10 preferably also includes a push plate 74. The push plate 74 may be secured to the rear 54 of the frame 12 at the base of the support member 52. The push plate 74 is preferably made from non-skid steel of sufficient rigidity t withstand a force strong enough to lift the forward end of the apparatus 10. It should be understood that it is not necessary to raise the forward end of the apparatus 1? in order to move it. However, by applying force to the push plate 74, any friction caused by the skirt 26 contacting the surface 16 is reduced, rendering the apparatus 10 easier to move.

Now it will be apparent that the apparatus of the present invention provides a small, compact and highly versatile portable blasting machine for treating cornered surfaces. The configuration of the forwardmost aspect of the housing of this apparatus permits the front of the blast zone to be brought up immediately adjacent a wall or other structure in front of the apparatus. Moreover, the adjustable handle permits the machine to be operated underneath and alongside structures which would prevent the use of portable blasting machines lacking these advantages.

Changes may be made in the combination and arrangement of the various parts, elements, steps and procedures described herein without departing from the spirit and scope of the invention as is defined in the following claims.

I claim:

1. A surface treating apparatus for treating a first surface intersected by a second surface which second surface defines a plane forming and angle with the plane of the first surface, the apparatus comprising:

a movable frame having a front and a rear;

a housing supported on the frame, wherein the housing has an opening at the bottom thereof defining a blast zone on the first surface, wherein the housing above the blast zone defines a blast corridor and a rebound corridor continuous with the opening, wherein the rebound corridor has a first linear portion which is substantially perpendicular to the plane of the first surface, and wherein the first linear portion of the rebound corridor and blast corridor form an acute angle;

a propeller supported in the housing adjacent the blast corridor for propelling abrasive material through the blast corridor towards the first surface, and wherein the propeller is capable of imparting sufficient kinetic energy to the abrasive material to treat the first surface and to cause the abrasive striking the first surface to rebound a distance therefrom into the first linear portion of the rebound corridor;

a hopper for collecting a supply of abrasive material and feeding the abrasive material to the propeller;

wherein the rebound corridor is further characterized by a second portion which directs the rebounding abrasive material from the first linear portion into the hopper; and wherein that portion of the housing which defines the first linear portion of the rebound corridor forms the forwardmost aspect of the apparatus so that the blast zone can be positioned adjacent the line of intersection between the first surface and the second surface.

2. The apparatus of claim 1 wherein the propeller comprises a centrifugal wheel.

3. The apparatus of claim 1 further comprising an adjustable handle movably attached to the rear of the frame whereby the distance of the handle from the first surface can be adjusted.

4. The apparatus of claim 3 wherein the handle is rotatable relative to the housing.

5. The surface treating apparatus of claim 4 further comprising a push plate secured to the rear of the frame, beneath the handle adapted for receiving pressure and positioned so that such pressure counterbalances the weight of the apparatus at the front of the frame thereby making the apparatus easier to move in a forward direction.

6. The apparatus of claim further comprising a rotatable handle.

7. The surface treating apparatus of claim 6 further comprising a push plate secured to the rear of the frame, beneath the handle adapted for receiving pressure and positioned so that such pressure counterbalances the weight of the apparatus at the front of the frame thereby making the apparatus easier to move in a forward direction.

8. The surface treating apparatus of claim 1 further comprising a push plate secured to the rear of the frame, beneath the handle adapted for receiving pressure and positioned so that such pressure counterbalances the weight of the apparatus at the front of the frame thereby making the apparatus easier to move in a forward direction.

9. The apparatus of claim 1 wherein the first linear portion has a substantially constant cross sectional area.

10. A surface treating apparatus comprising:

a movable frame having a front and a rear;

a housing supported on the frame, wherein the housing has an opening at the bottom thereof defining a blast zone on the surface to be treated, said opening having a width when viewed from the front of the frame, wherein the housing above the blast zone defines a blast corridor and a rebound corridor, wherein the rebound corridor has a first portion continuous with the blast zone, wherein the rebound corridor and the blast corridor form an acute angle;

a propeller supported in the housing adjacent the blast corridor for propelling abrasive material through the blast corridor towards the first surface, and wherein the propeller is capable of imparting sufficient kinetic energy to the abrasive material to treat the first surface and to cause the abrasive material striking the first surface to rebound a distance therefrom into the first linear portion of the rebound corridor;

a hopper for collecting a supply of abrasive material and feeding the abrasive material to the propeller;

wherein the rebound corridor is further characterized by a second portion which directs the rebounding abrasive material from the first portion into the hopper; and a handle comprising an extension member having a longitudinal axis and a first end and a second end, the handle further comprising a gripping member attached to the first end of the extension member, wherein the second end of the extension member is movably attached to the rear of the frame so that the distance of the gripping member from the surface to be treated can be adjusted and so that the gripping member may be rotated about the longitudinal axis of the extension member, and wherein the width of the gripping member is greater than the width of said opening.

11. The surface treating apparatus of claim 10 further comprising a push plate secured to the rear of the frame, beneath the handle adapted for receiving pressure and positioned so that such pressure counterbalances the weight of the apparatus at the front of the frame thereby making the apparatus easier to move in a forward direction.

12. The apparatus of claim 10 wherein the propeller comprises a centrifugal wheel.

13. The apparatus of claim 10 wherein the first portion of the rebound corridor has a substantially constant cross sectional area.

* * * * *

UNITED STATES PATENT AND TRADEMARK OFFICE

CERTIFICATE OF CORRECTION

PATENT NO. : 5,142,831

DATED : September 1, 1992

INVENTOR(S) : Nelson

It is certified that error appears in the above-indentified patent and that said Letters Patent is hereby corrected as shown below:

TITLE PAGE:

In the References Cited, U.S. Patent No. 209,173 issued to Kidwell, the date "1978" should be -- 1878 --.

In the References Cited, United Kingdom Patent No. 2900, the date "1970" should be -- 1870 --.

Column 1, line 24, the word "forma" should be -- form a --.

Column 1, line 36, the word "form" should be -- from --.

Column 3, line 33, the words "in the in the" should be -- in the --.

Column 4, line 8, after the word "will," please insert the word -- be --.

Column 4, line 23, the word "preferable" should be -- preferably --.

Column 4, line 36, the word "t" should be -- to --.

Column 4, line 39, the word "1?" should be -- 10 --.

Column 4, line 62, the word "and" should be -- an --.

Column 5, line 12, after the word "abrasive", please insert the word -- material --.

UNITED STATES PATENT AND TRADEMARK OFFICE

CERTIFICATE OF CORRECTION

PATENT NO. : 5,142,831

DATED : September 1, 1992

INVENTOR(S) : Nelson

It is certified that error appears in the above-indentified patent and that said Letters Patent is hereby corrected as shown below:

Column 5, line 43, after the word "claim," please insert the numeral -- 1 --.

Signed and Sealed this

Fourteenth Day of December, 1993

*Attest:*

*Attesting Officer*

Bruce Lehman

BRUCE LEHMAN

*Commissioner of Patents and Trademarks*